US007888823B2

(12) United States Patent
Den Ridder

(10) Patent No.: US 7,888,823 B2
(45) Date of Patent: Feb. 15, 2011

(54) REMOTELY CONTROLLABLE SWITCH FOR INCORPORATING IN A WALL SOCKET

(75) Inventor: Franciscus Petrus Den Ridder, Zevenbergen (NL)

(73) Assignee: Icom Technology B.V., Zevenbergen (NL)

( * ) Notice: Subject to any disclaimer, the term of this patent is extended or adjusted under 35 U.S.C. 154(b) by 937 days.

(21) Appl. No.: 10/591,210

(22) PCT Filed: Feb. 28, 2005

(86) PCT No.: PCT/NL2005/000145

§ 371 (c)(1),
(2), (4) Date: May 23, 2007

(87) PCT Pub. No.: WO2005/089029

PCT Pub. Date: Sep. 22, 2005

(65) Prior Publication Data

US 2007/0278964 A1 Dec. 6, 2007

(30) Foreign Application Priority Data

Mar. 2, 2004 (NL) ..... 1025613

(51) Int. Cl.

| | |
|---|---|
| ***H01H 9/54*** | (2006.01) |
| ***H01H 33/59*** | (2006.01) |
| ***H01H 47/00*** | (2006.01) |
| ***H01H 85/46*** | (2006.01) |
| ***H01H 3/26*** | (2006.01) |
| ***H01H 3/28*** | (2006.01) |

(52) U.S. Cl. ..... 307/140

(58) Field of Classification Search ..... 307/40, 307/139, 140, 116

See application file for complete search history.

(56) References Cited

U.S. PATENT DOCUMENTS

| | | | | |
|---|---|---|---|---|
| 5,340,954 | A | 8/1994 | Hoffman et al. | |
| 5,731,664 | A | 3/1998 | Posa | |
| 5,905,442 | A | 5/1999 | Mosebrook et al. | |
| 6,114,812 | A | 9/2000 | Lee | |
| 6,522,078 | B1 | 2/2003 | Okamoto et al. | |
| 6,687,487 | B1 * | 2/2004 | Mosebrook et al. | 455/11.1 |
| 2003/0041226 | A1 | 2/2003 | Shih et al. | |
| 2006/0119187 | A1 * | 6/2006 | Newman | 307/139 |

FOREIGN PATENT DOCUMENTS

| | | |
|---|---|---|
| EP | 0516008 | 12/1992 |
| FR | 2724776 | 3/1996 |

* cited by examiner

*Primary Examiner*—Jared J Fureman
*Assistant Examiner*—Carlos Amaya
(74) *Attorney, Agent, or Firm*—The Webb Law Firm

(57) ABSTRACT

The invention relates to a remotely controllable switch unit for switching the mains inside an electrical installation, wherein the switch unit comprises an electrically controllable switch, a control circuit for controlling the switch, a receiver coupled to the control circuit for receiving wireless signals, wherein the switch unit is adapted for mounting in a housing of a wall socket. As a result of these measures it is no longer necessary to place a separate unit between the wall socket and the plug for connecting thereto. The appearance of an electrical installation is hereby improved. Relative to the "bus" system and similar devices, the advantage results that arranging of such a switch unit can take place in particularly simple manner; no changes need after all be made to the wiring of the electrical installation.

17 Claims, 3 Drawing Sheets

REMOTELY CONTROLLABLE SWITCH FOR INCORPORATING IN A WALL SOCKET

BACKGROUND OF THE INVENTION

1) Field of the Invention

The invention relates to a remotely controllable switch unit for switching the mains inside an electrical installation, wherein the switch unit comprises: an electrically controllable switch, a control circuit for controlling the switch and a receiver coupled to the control circuit for receiving wireless signals.

2) Description of the Related Art

Such switch units are generally known. They are formed by separate units which are provided on their rear side with pins corresponding with the pins of a plug. Such units can hereby be placed in a wall socket. They are provided with the female part of a wall socket so that a plug of an electrical appliance for switching can be connected thereto.

Such units are known as on/off switch, and also as dimmer. Although such switch units provide a great flexibility, since they can after all be placed later, they result in a less attractive appearance; they do after all form an extra element between the wall socket and the plug of the appliance for connecting hereto.

Further known from the prior art are so-called "bus" systems, such as the "Instabus®" system. These are systems which, although they are primarily intended for building of public utilities, are also applied in home installations and whereby centralized control is possible of lighting, heating and other comfort functions such as window coverings.

The installing of such "bus" systems is very expensive. This is particularly the case when they have to be arranged in an already existing building. This is caused by the fact that such a system does not function wirelessly but operates by means of a large number of signal wires which must be incorporated in the installation.

SUMMARY OF THE INVENTION

The object of the present invention is to provide a system wherein the above stated drawbacks of the prior art are avoided.

This object is achieved in that the switch unit is adapted for mounting in a housing of a wall socket. Such a housing is also known as a "box" in which not only wall sockets are mounted, but also for instance switches or dimmers.

As a result of these measures it is no longer necessary to place a separate unit between the wall socket and the plug for connecting thereto. The appearance of an electrical installation is hereby improved.

Relative to the "bus" system and similar devices, the advantage results that arranging of such a switch unit can take place in particularly simple manner; no changes or additions need after all be made to the wiring of the electrical installation. After purchase, such a switch unit can be readily arranged in an existing flush-mounted box to replace a normal wall socket.

Operation of the switch unit takes place wirelessly, so that no wiring need be arranged for this purpose.

In the Netherlands, Germany and France use is preferably made of flush-mounted boxes with an overall depth of 40 mm. Boxes are of course available with a greater overall depth but these are only applied when this is absolute necessary. In existing construction use is also made mainly of flush-mounted boxes with an overall depth of 40 mm. The switch unit therefore preferably has a depth of a maximum of 32 mm. The remaining 8 mm are necessary for guiding of the connecting wires.

Flush-mounted boxes of other depths occur in other countries. The invention likewise attempts to provide switch units for flush-mounted boxes in such countries. According to a preferred embodiment, the invention provides for this purpose the measure that the switch unit is combined with a flush-mounted box, and that the maximum depth of the switch unit is at least 8 mm smaller than the maximum depth of the flush-mounted box.

In the above two embodiments a space of 8 mm is taken into account in each case between the greatest depth of the switch unit and the box; partly depending on local regulations, it is possible to take into account different intermediate spaces, such as 5, 6, 7, 9 or 10 mm.

According to a first embodiment, the switch unit is provided with an operating element of usual type for operating the switch. Such a switch unit is used to replace a conventional switch in an installation in order to control therewith a ceiling lamp connected to a power point. Such a switch unit serves to replace a normal switch for operating a lamp. This latter can then be operated by the operating element integrated in the switch unit and via the wireless transmitter.

According to another preferred embodiment, the switch unit is provided with the female part of a wall socket. With this embodiment the load connected thereto, such as a standard lamp, can be controlled. It is pointed out here that, particularly when the female part of the wall socket is present, the available space is extremely limited.

As already stated in the preamble, the switch unit can be adapted to perform a single on/off switching function. Such a function is for instance useful for switching a power point on and off.

According to another preferred embodiment, the switch unit is provided with a dimmer. These dimmers will in many cases be combined with a switch. Such an embodiment is for instance applicable for switching, and thus also dimming, interior lighting. The use of a dimmer is otherwise accompanied by the generation of heat; because such a dimmer is arranged in a house, there is little airflow, so that little heat can be discharged, and the heat produced by the dimmer can result in high temperatures.

According to yet another preferred embodiment, the switch can be controlled between an on/off function and a dimming function, and the control circuit is adapted to sense the nature of a load connected to the female part of the wall socket and to block the dimming function when the load is not substantially formed by a resistance. This embodiment is for instance applicable to a wall socket on which diverse appliances are used, for instance a standard lamp or a vacuum cleaner. When a vacuum cleaner is connected, the dimming function must of course be blocked to prevent damage to the dimmer and vacuum cleaner. This is realized by sensing the nature of the load.

Yet another preferred embodiment provides the measure that the switch unit also comprises a transmitter connected to the control circuit. This transmitter can be used to feed back for instance the nature of the impedance to the wireless control device. It is moreover possible to have such a switch unit form part of a larger system, so that not only can various of such switch units be controlled with a control unit, but the switch units can also communicate with each other. A network of wireless connections is hereby created between junctions formed by such switch units. It is hereby possible to build up a large system, the function of which is comparable to that of a "bus" system.

It is convenient that the switching function can be carried out when the network is not functioning. For this purpose the switch unit comprises an operating element for at least operating the switching function.

It is also good to be able to determine whether or not the relevant switch is switched on. The switch is provided for this purpose with a signal light source which comes on when the switch unit is switched on. Use can otherwise be made here of a two-coloured LED, the colour of which depends on whether the switch is closed.

Another preferred embodiment provides the measure that the switch unit comprises a printed circuit board on which a number of components is placed, and that the printed circuit board extends transversely of the pin direction of the socket. The available space is extremely small. The inventors have found that the above stated arrangement of the components results in an effective use of the space.

A further improvement of the use of the available space is achieved when the at least one of the printed circuit boards extends over substantially the whole surface area of the housing, and when it is provided with a recess. This recess is then used for feed-through of the connecting wires.

Yet another specific embodiment provides the measure that the switch unit comprises a contact carrier which is manufactured from insulating material and on which contacts are arranged for the pins of the male plug and on which terminals are arranged for connecting the contacts to wires, and wherein at least one of the connections between contacts and terminals is interrupted. This is also a space-saving configuration.

The available space is used even more effectively when the contact carrier is formed by a housing manufactured from plastic and having a substantially cylindrical part and a mounting flange. A separate mounting plate hereby becomes unnecessary, which results in a cost saving.

An attractive embodiment provides the measure that the switch unit comprises a power supply circuit which is adapted to connect a capacitor to the mains for only a short time after the zero passage of the mains. This embodiment avoids transformers or other bulky components, while heat dissipation is also countered, so that an extremely compact and non-dissipative power supply circuit is obtained.

A relay is preferably applied. The inventor has found that, despite the volume being larger than that of a semiconductor switching element, a relay is more attractive as a result of the negligible generation of heat of a relay.

Yet another more particular preferred embodiment provides the measure that the switch unit is adapted to measure the power of the load connected to the switch unit. This function can be used, as a safety measure, to monitor the power controlled by a switch unit, but also to detect the consumed energy, for instance in a power management system.

When applied in a power management system, it is important that the control circuit is adapted to transmit a signal representing the measured power to another element of the network.

BRIEF DESCRIPTION OF THE DRAWINGS

The present invention will be elucidated hereinbelow with reference to the accompanying drawing, in which.

DETAILED DESCRIPTION OF THE PREFERRED EMBODIMENTS

Figure 1:
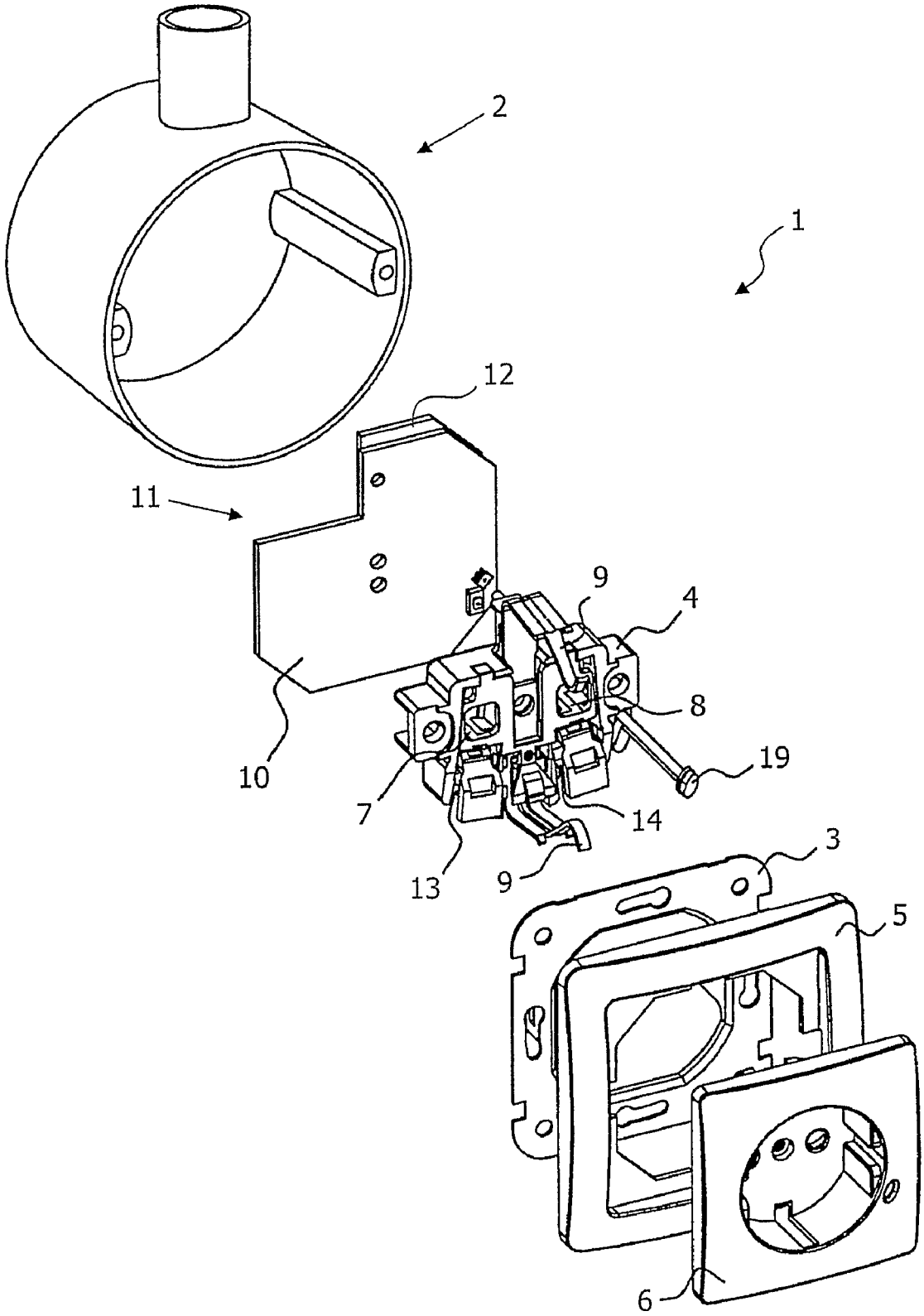
FIG. 1 is an exploded view of a switch unit according to the invention incorporated in a housing of a wall socket.

FIG. 1 shows a switch unit designated in its entirety with 1, which is suitable for arranging in a housing 2 of a wall socket. The switch unit comprises the normal components of a wall socket, such as a metal mounting plate 3, a contact carrier 4 which is manufactured from insulating material, a frame plate 5 and a cover plate 6. All these components correspond with those of a normal wall socket. Contact carrier 4 is provided in usual manner with female contacts 7 and 8, and with earth contact lips 9. It is noted here that earth contacts are not essential to the invention, but that the use of earthed wall sockets is generally required in the building of new houses and conversions.

On the rear side of contact carrier 4 is mounted a printed circuit board 10, for instance by a screw connection. On the rear side of this printed circuit board are arranged the parts of the components necessary for performing the function. Owing to its rounded corners, the board is suitable for receiving in the relevant box. The board is provided with a recess 11 in which a sizeable component such as a coil can be accommodated. A second, smaller printed circuit board 12 is further arranged, on which high-frequency components are preferably placed.

Figure 2:
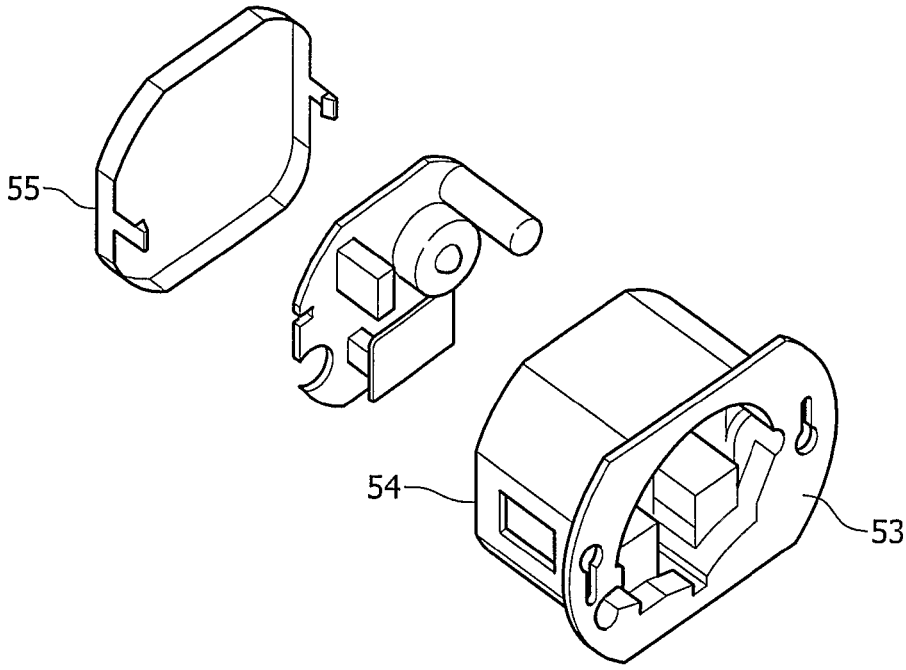
FIG. 2 is an exploded view of a detail of an alternative embodiment.

FIG. 2 shows an alternative embodiment wherein a large number of components is placed on a substantially cylindrical carrier 54, which is formed integrally with a flange 53. The carrier is preferably manufactured from plastic. The carrier here replaces contact carrier 4 and mounting plate 3 of the first embodiment. The cylindrical form combined with a cover 55 results in protection of the components against the high voltage. There is here also a combination with a printed circuit board on which components are placed.

Figure 3:
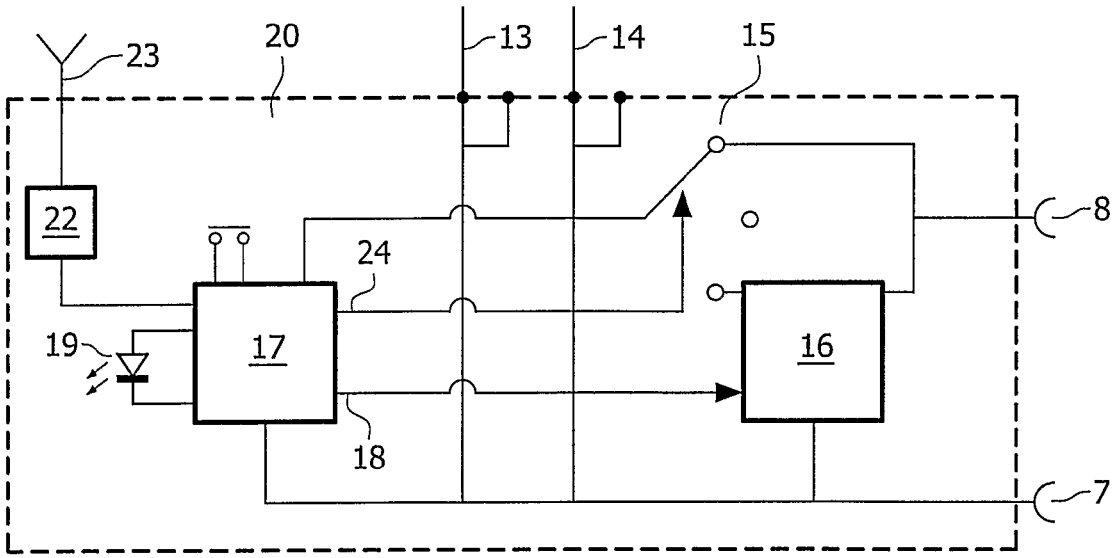
FIG. 3 is a diagram explaining the operation of the switch unit according to the invention.

The operation of this switch unit will be elucidated on the basis of FIG. 3. The switch unit comprises two pairs of connecting contacts 13, 14 such as are also applied in normal wall sockets. Pairs are applied to make interconnection possible. The one female contact 7 is connected to both connecting contacts 13, while the other female contact 8 is connected to a switch 15 and to dimming circuit 16. Switch 15 has three positions, i.e. the switched-on position shown in FIG. 2 wherein female contact 8 is directly connected to connecting contact 14, a second position in which the switch is switched off, and a third function in which dimming circuit 16 is switched on. The circuit further comprises a control circuit 17 which is connected for its power supply to the pairs of contacts 13 and 14, and which is provided with two output connections 17, 24 respectively for controlling switch 15 and dimmer 16 respectively. A high-frequency transmitting and receiving circuit is further accommodated in the control circuit.

Further connected to control circuit 17 is a LED 19, as well as a pressure switch 20. The push-button is herein formed by a light-conducting plastic, which is connected on one side to LED 19 so that it is possible to observe from outside whether or not LED 19 on. The control circuit can operate switch 15 and dimming circuit 16 for the purpose of thereby controlling the power supplied to the load.

The control circuit receives its commands via a high-frequency transmitter receiver 22 which is provided with an antenna 23 for receiving and transmitting high-frequency signals.

The intelligence of the control circuit is such that the switch functions as a junction in a network of wireless connections. The information package is herein transmitted in controlled manner. It will be apparent that the switch unit according to the invention can also be controllable by other transmission protocols.

Figure 4:
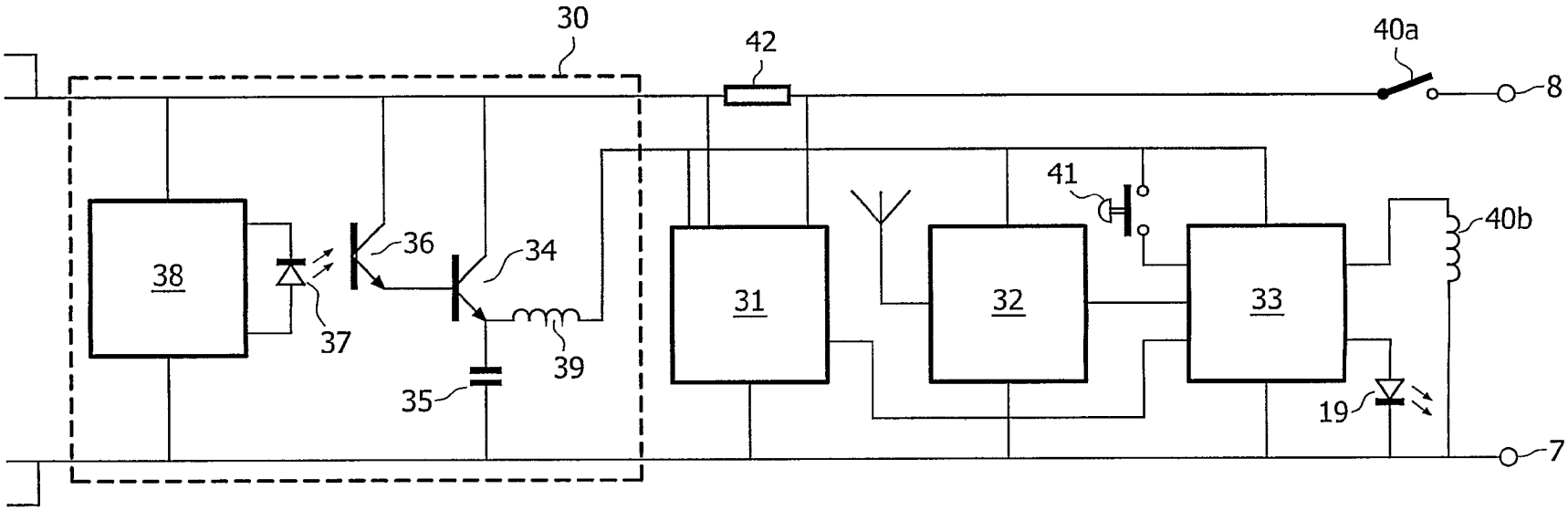
FIG. 4 is an alternative diagram of the switch unit according to the invention.

FIG. 4 shows an alternative circuit. This circuit differs from the circuit shown in FIG. 3 due to the absence of the dimmer function and a number of applied functions. This circuit comprises a power supply circuit designated in its entirety with 30, a power measuring circuit 31, a transmitter/receiver 32 and a control circuit 33. Power supply circuit 31 comprises a switch 34 embodied as a transistor, the emitter of which is connected to a capacitor 35. The collector is connected to the phase of the mains voltage. The base of transistor 34 is connected to a phototransistor 36 which, when illuminated by a LED 37, conducts and thereby opens transistor 34. LED 37 is connected to a circuit 38 which detects the zero passage of the mains voltage and actuates the LED 37 for a time following the zero passage, so that during this period of time the transistor 34 conducts and capacitor 35 charges. Connected to the connection between capacitor 35 and transistor 34 is a coil 39 which has a filtering function. Other filter configurations can of course be applied instead of this coil. It is hereby possible to derive a supply voltage for the electronic circuits from the mains voltage without expensive or bulky components.

In order to keep track of the load connected to the switch unit and to calculate the power therefrom, a power measuring circuit 31 is arranged which measures the voltage between zero and phase and the current flowing through the phase conductor. A small resistor 42 is arranged for this purpose in the phase conductor. Other current measuring principles, such as a current transformer, can however also be applied instead.

As in the other embodiment, a transmitter/receiver 32 is arranged which is coupled to an antenna 23. The transmitter/receiver is also connected to control circuit 33 for transmitting the commands. There is likewise a connection between the power measuring circuit 31 and transmitter/receiver 32 so that the data collected by the power measuring circuit 31 are transmitted to the network.

Finally, a control circuit 33 is arranged which is adapted to operate switch 40. This switch is formed by a relay which is provided with contacts 40*a* and a coil 40*b*, which coil is connected to control circuit 37. Surprisingly, it is more attractive to apply a mechanical relay than an electronic switch. This is related, among other things, to the lack of heat generation. The control circuit is also adapted to control a LED 19 which indicates whether the switch is closed. Control circuit 33 is connected to transmitter/receiver 32 for receiving the input signals. A manually operable switch 41 is also arranged for controlling the switch unit without the wireless control system.

The invention claimed is:

1. A remotely controllable switch unit for switching the mains inside an electrical installation, wherein the switch unit comprises:

an electrically controllable switch;

a control circuit for controlling the switch; and a receiver coupled to the control circuit for receiving wireless signals, wherein the switch unit is adapted for mounting in a housing of a wall socket and is provided with a female part of the wall socket such that the wall socket is configured to receive a plug of an electrical device and wherein the switch unit is provided with a dimmer and wherein the control circuit is adapted to sense the nature of a load connected to the female part of the wall socket and to block the dimming function when the load is not substantially formed by a resistance.

2. The switch unit as claimed in claim 1, wherein the depth of the switch unit is smaller than 32 mm.

3. The switch unit as claimed in claim 1, wherein the switch unit is combined with a flush-mounted box, and that the maximum depth of the switch unit is at least 8 mm smaller than the maximum depth of the flush-mounted box.

4. The switch unit as claimed in claim 1, wherein the switch unit is provided with an operating element of usual type for operating the switch.

5. The switch unit as claimed in claim 1, wherein the switch unit is provided with an on/off switch.

6. The switch unit as claimed in claim 1, wherein the switch unit comprises a transmitter connected to the control circuit and that the switch unit is adapted to function as a junction in a network of transmitters/receivers.

7. The switch unit as claimed in claim 1, wherein an operating element is arranged on the switch unit for operating at least the switch.

8. The switch unit as claimed in claim 7, wherein a signal light source comes on when the switch unit is switched on.

9. The switch unit as claimed in claim 1, wherein the switch unit comprises at least one printed circuit board on which a number of components are placed, and that the printed circuit board extends parallel to the mounting surface of the housing.

10. The switch unit as claimed in claim 9, wherein at least one of the printed circuit boards extends over substantially the whole surface area of the housing, but is provided with a recess.

11. The switch unit as claimed in claim 1, wherein the switch unit comprises a contact carrier which is manufactured from insulating material and on which contacts are arranged for the pins of the male plug and on which terminals are arranged for connecting the contacts to wires, and wherein at least one of the connections between contact and terminals is interrupted.

12. The switch unit as claimed in claim 11, wherein the contact carrier is formed by a housing manufactured from plastic and having a substantially cylindrical part and a mounting flange.

13. The switch unit as claimed in claim 1, wherein the switch unit comprises a power supply circuit which is adapted to connect a capacitor to the mains for only a short period of time after the zero passage of the mains.

14. The switch unit as claimed in claim 1, wherein the switch unit comprises a relay for switching the connection between one of the contacts and one of the terminals.

15. The switch unit as claimed in claim 14, wherein the control circuit is adapted to transmit a signal representing the measured power to another element of the network.

16. The switch unit as claimed in claim 1, wherein the switch unit is adapted to measure the power of the load connected to the switch unit.

17. A remotely controllable switch unit for switching the mains inside an electrical installation, wherein the switch unit comprises:

an electrically controllable switch;

a control circuit for controlling the switch; and a receiver coupled to the control circuit for receiving wireless signals, wherein the switch unit is adapted for mounting in a housing of a wall socket configured to receive a plug of an electrical device, and the switch unit is provided with a dimmer and the control circuit is adapted to sense the nature of a load connected to the wall socket when a plug of an electrical device is coupled thereto and to block the dimming function when the load is not substantially formed by a resistance.

* * * * *